US007144229B2

(12) United States Patent
Ishida et al.

(10) Patent No.: US 7,144,229 B2
(45) Date of Patent: Dec. 5, 2006

(54) SEALED TYPE ELECTRICALLY DRIVEN COMPRESSOR

(75) Inventors: Yoshinori Ishida, Kanagawa (JP); Toshihiko Ota, Kanagawa (JP); Terumasa Ide, Kanagawa (JP); Makoto Katayama, Kanagawa (JP); Takafumi Horiguchi, Kanagawa (JP); Takahide Nagao, Kanagawa (JP)

(73) Assignee: Matsushita Refrigeration Company, Shiga (JP)

( * ) Notice: Subject to any disclaimer, the term of this patent is extended or adjusted under 35 U.S.C. 154(b) by 323 days.

(21) Appl. No.: 10/478,874

(22) PCT Filed: Jul. 15, 2002

(86) PCT No.: PCT/JP02/07156

§ 371 (c)(1),
(2), (4) Date: Nov. 25, 2003

(87) PCT Pub. No.: WO03/008805

PCT Pub. Date: Jan. 30, 2003

(65) Prior Publication Data

US 2004/0151604 A1 Aug. 5, 2004

(30) Foreign Application Priority Data

Jul. 16, 2001 (JP) ..... 2001-214997

(51) Int. Cl.
*F04B 17/00* (2006.01)
*F04B 35/04* (2006.01)
*F01M 1/04* (2006.01)
*F04M 1/00* (2006.01)

(52) U.S. Cl. ..... 417/415; 417/423.1; 417/423.12; 417/423.13; 184/6.5; 184/6.6; 184/6.8; 184/6.18

(58) Field of Classification Search ..... 417/415, 417/424.1, 423.1, 423.12, 423.13; 184/6.6, 184/6.8, 6.18, 6.5
See application file for complete search history.

(56) References Cited

U.S. PATENT DOCUMENTS

| | | | | |
|---|---|---|---|---|
| 3,674,382 | A * | 7/1972 | Kubota | 417/372 |
| 3,692,435 | A * | 9/1972 | Iida et al. | 417/372 |
| 3,848,702 | A * | 11/1974 | Bergman | 184/6.3 |
| 4,236,879 | A * | 12/1980 | Abe | 417/368 |
| 4,623,306 | A * | 11/1986 | Nakamura et al. | 418/55.6 |
| 5,288,211 | A * | 2/1994 | Fry | 417/312 |
| 5,707,220 | A | 1/1998 | Krueger et al. | |

(Continued)

FOREIGN PATENT DOCUMENTS

EP 0 587 402 A1 3/1994

(Continued)

*Primary Examiner*—Anthony D. Stashick
*Assistant Examiner*—Ryan P. Gillan
(74) *Attorney, Agent, or Firm*—McDermott Will & Emery LLP

(57) ABSTRACT

A hermetic electric compressor is capable of efficiently pumping up a necessary amount of lubricating oil even at low-speed rotation and has a simple constitution to provide an excellent workablity in assembling. The hermetic electric compressor includes an oil pump. The oil pump includes (i) a slanting channel formed in the lower portion of a main shaft and slanting from the lower portion to the upper portion thereof outwardly, (ii) a throttle formed at the bottom end of the main shaft and having an inlet port of diameter smaller than the section of the slanting channel at the center thereof, and (iii) a lower communicating passage for providing a communication between the bottom end of a spiral groove and the slanting channel. This constitution is capable of effectively lift the head of the lubricating oil.

11 Claims, 12 Drawing Sheets

U.S. PATENT DOCUMENTS 6,746,216 B1 * 6/2004 Sun ..... 417/410.5

FOREIGN PATENT DOCUMENTS

| | | |
|---|---|---|
| JP | 62-44108 | 9/1987 |
| JP | 63-154787 | 10/1988 |
| JP | 3-112584 | 11/1991 |
| JP | 3-129787 | 12/1991 |
| JP | 2000-87856 A | 3/2000 |
| WO | WO 00/01949 | 1/2000 |

* cited by examiner

SEALED TYPE ELECTRICALLY DRIVEN COMPRESSOR

FIELD OF THE INVENTION

The present invention relates to a hermetic electric compressor for use in freezing and refrigerating equipment or a room air-conditioner. It more particularly relates to an oiling and lubricating system for supplying lubricating oil reserved in a hermetic shell to rotating and sliding parts in the hermetic electric compressor by a centrifugal force of a rotation of a crankshaft.

BACKGROUND OF THE INVENTION

Recently, there has been a strong demand for reduction in power consumptions and noise in a hermetic electric compressor for use in a domestic freezer and refrigerator or a room air-conditioner. For a reduction in power consumptions and a noise, an inverter-driven compressor is operated at a lower rotational speed (e.g. approx. 1,800 revolutions per minute (rpm) for a domestic refrigerator).

On the other hand, many lubricating oil pump systems for a hermetic electric compressor utilize a centrifugal force resulting from a rotation of a crankshaft because a lubricating oil reserved in the bottom of a hermetic shell is pumped up to upper sliding parts However, because the centrifugal force is proportional to the square of a rotational speed of a crankshaft, a power of pumping up oils is smaller as a rotational speed is lower. This causes a serious problem in the operation at a lower rotational speed.

A prior art is described hereinafter.

One of conventional hermetic electric compressors is disclosed in the Japanese Patent Unexamined Publication No. 1987-44108. FIG. 14 shows a sectional view of the conventional hermetic electric compressor. With reference to FIG. 14, a compressor body 500 is housed in a hermetic shell 501. In the hermetic shell 501, a frame 502 is disposed in the center, an electric motor 503 in the lower portion, and a compressing mechanism 504 in the upper portion. A crankshaft 505 penetrates through a bearing 506 of the frame 502. While the outer diameter portion of the crankshaft 505 is fixed to rotor 507 of the electric motor 503, an eccentric crankshaft 508 is engaged with a slider 510 of a piston 509 in the compressing mechanism 504 to perform a well-known compressing action.

Inside of the crankshaft 505, a slanting channel 511 having a relatively small diameter extends from the bottom end of the crankshaft 505 to the bottom end of a bearing 506. The slanting channel is opened to the outer periphery of the crankshaft 505 by a first lateral hole 512. A spiral groove 513 is formed on a portion of the crankshaft 505 inside of the bearing 506. The bottom end of the spiral groove is in communication with the lateral hole 512. At the top end of the spiral groove, the bottom end of a longitudinal hole 514 provided in an eccentric shaft 508 is opened to a thrust bearing sliding on a surface 515. At the same time, the bottom end of the longitudinal hole 514 intersects a second lateral hole 516. In other words, the crankshaft 505 is constituted so that the holes 512 and 516 are opened directly to the outer surface of the crankshaft 505. Additionally, at a bottom end 517 of the crankshaft 505, the slanting channel 511 is opened to a lubricating oil 518.

FIG. 15 is a detail sectional view of the bottom end 517 of the crankshaft 505 immersed in the lubricating oil 518. The lubricating oil 518 in the slanting channel 511 is formed into a free surface shaped like a parabola by a centrifugal force resulting from a rotation of the crankshaft 505. At this time, an ascending current 519 of the lubricating oil 518 sucked through the opening surface of the slanting channel 511 at the bottom end 517 of the crankshaft 505 is separated into two branches 520 and 521. A branch 520 is moved upwardly by the centrifugal force resulting from the rotation of the crankshaft 505. Another branch 521 slips in the vicinity of the bottom end of the slanting channel 511 and escapes through the opening surface of the slanting channel 511 out of the slanting channel 511. This branch 521 merges with the ascending current 519 sucked through the opening surface of the slanting channel 511 and flows into the slanting channel 511 again to form a short circuit.

In the constitution of such a prior art, the lubricating oil in the slanting channel 511 that directly extends from the bottom end of the crankshaft 505 diagonally to the top is immediately decentered by the centrifugal force only on the inner surface of the slanting channel 511 on the outer peripheral side, in a position slightly above the oil level of the lubricating oil 518 reserved in the lower portion of the compressor 500. Therefore, a force of lifting the lubricating oil is excellent. However, the ascending current 519 shown by the arrow, i.e. the lubricating oil that has been sucked through the opening surface of the slanting channel 511 at the bottom end of the crankshaft 505, is separated into the branches 520 and 521 each shown by the arrow. The branch 520 is moved upwardly by the centrifugal force. The branch 521 flows through the opening surface of the slanting channel 511 out of the slanting channel 511. This branch 521 merges with the ascending current 519 sucked through the opening surface of the slanting channel 511 and flows into the slanting channel 511 again to repeat short circuits. Repeating the short circuits is a major factor of the loss in the amount of the lubricating oil 518 flowing into the slanting channel 511. Further, because the centrifugal force is smaller at a lower rotational speed of the crankshaft 505, the rate of the branch 521 flowing out of the slanting channel 511 increases. This causes a drawback of delivering an insufficient amount of the lubricating oil to the sliding part in the upper portion.

Another hermetic electric compressor constituted to increase a centrifugal force for sucking an oil is disclosed in U.S. Pat. No. 5,707,220. However, this prior art has a complicated path of lubricating oil and a complicated constitution, and thus requires a large number of components. This causes problems of unstable supply of a lubricating oil and poor workablity in assembling.

Still another conventional hermetic electric compressor is disclosed in WO00/01949 Publication. This compressor employs a mechanical oil pump system in which the viscosity effect of lubricating oil pumps up a lubricating oil along a spiral groove between a stator having the spiral groove in the outer peripheral, surface thereof and a rotating sleeve. This system is highly reliable in ensuring an amount of supplied oil in a low-speed range (1,200 to 1,800 rpm). However, the constitution is extremely complicated and requires a larger number of components in comparison with an oil pump system using a centrifugal force. Therefore, this mechanical oil pump system has drawbacks of an expensiveness and a poor workability in assembling.

The present invention solves these conventional problems and aims to provide a simple lubricating oil pump system for a hermetic electric compressor that is capable of efficiently pumping up lubricating oil even at a low-speed rotation and has an excellent workablity in assembling.

DISCLOSURE OF THE INVENTION

A hermetic electric compressor of the present invention has the following constitutions: an electric motor including a stator and a rotor; a compressing element for compressing refrigerant by a rotation of a crankshaft fixed to the rotor of the electric motor; and a hermetic shell for housing the electric motor and the compressing element and including a reservoir for storaging a lubricating oil. The crankshaft is consisted of at least a main crankshaft, and a eccentric crankshaft for driving the compressing element. The hermetic electric compressor further includes an oil pump for supplying the lubricating oil in the sump to the main crankshaft and the eccentric crankshaft by a rotation of the crankshaft. The oil pump is constituted to have (i) a slanting channel inside of the main crankshaft that has a predetermined length from the bottom end of the main crankshaft immersed in the sump and inclines with respect to the center axis of the main crankshaft, (ii) a throttle provided at the bottom end of the main crankshaft and having a cross-sectional area smaller than that of the slanting channel, (iii) a communicating passage provided at the top end of the slanting channel, (iv) a spiral groove in communication with the communicating passage, provided in the outer periphery of the main crankshaft, and (v) a through hole in communication with the spiral groove, provided in the eccentric crankshaft.

Because of this constitution, the centrifugal force resulting from rotation of the crankshaft is exerted on the lubricating oil at the bottom end of the main crankshaft surrounded by the throttle and the throttle receives the downward force. This increases the upward force resulting from the centrifugal force and moves the lubricating oil upwardly in the slanting channel. Further, because the incline of the slanting channel effectively lifts the head of the lubricating oil, a force of delivering a large amount of oil can be obtained.

Additionally, because the crankshaft is operated at rotational speeds ranging from 1,200 to 1,800 rpm, the power input of the compressor is minimized. Together with a stable lubrication, an operation at the low power consumption is allowed.

Further, the ratio of the distance from the most bottom end of the main crankshaft to the center of the communicating passage to the diameter of the main crankshaft in the area housing the slanting channel is set to E. The ratio of the maximum length from the center axis of the main crankshaft to the outer diameter of the slanting channel to the diameter of the main crankshaft is set to F. The relation between the ratios E and F is set to be shown by the following equation:

$$F \geqq 0.166E^2 - 0.683E + 1.44$$

Setting the ratios to satisfy the above equation optimizes the dimensions of the oil pump and thus provides an oil pump maximizing the utilization of the centrifugal force. Thus, a delivering force of a large amount oil can be obtained even in operation at a low speed revolution.

As for the throttle, a disk-shaped cap is inserted in and engaged with the bottom end of the main crankshaft. Thus, the material cost is low and the throttle can be assembled without positioning the cap by mistake.

Additionally, the ratio of the diameter of the slanting channel to the diameter of the inlet port provided at the center of the throttle is set to 1:0.25 to 0.5. This provides an oil pump in which an amount of supplied oil can be changed in the range of high-speed operation while the amount of supplied oil in the range of low-speed operation is kept a maximum. Thus, an appropriate amount of supplied oil can be obtained in operation at each rotational speed.

Further, a divider shaped like a flat plate is inserted in and engaged with the slanting channel. The divider prevents oil from slipping in the slanting channel and ensures stable lubrication especially in operation at low rotational speeds.

The divider is shaped like a vertically symmetrical flat plate. The divider has a semi-circular notch in substantially the center at least at the bottom end. The divider also has a press fit portion in which the width of almost the longitudinal center is larger than those of the top and bottom ends. The semi-circular notches provided at the both ends of the divider keeps the ratio of two divided openings of the inlet port in the throttle unchanged even when the bottom end of the divider is displaced from the center of the throttle. Increasing the width of the portion in the vicinity of the longitudinal center allows the divider to be inserted from any of the top and bottom ends thereof and prevents the divider from curving, thus increasing the workablity in assembling.

Further, a step is provided in a position in the direction of the depth of the slanting channel from the bottom end thereof. The distance from the bottom end of the slanting channel to the step is equal to the length of the divider. This constitution allows the slanting channel to be manufactured at a plurality of processes and thus increases an accuracy of finishing. Additionally, when the divider is inserted into the slanting channel, the edge of the divider at the top end thereof is held by the step in the slanting channel. This allows assembling without positioning the divider by mistake.

Further, the compressor is constituted so that a conical portion is formed at the top end of the slanting channel and at least a part of the communicating passage intersects the conical portion. This constitution can thicken the portion of the crankshaft above the communicating passage and thus prevent a corrosion (a phenomenon of breakage at the bottom of a spiral groove developing into a large hole that occurs in a thin portion) likely to occur in this portion.

Further, the compressor is provided a vent communicating passage for communication between the slanting channel and the outer peripheral surface of the main crankshaft and opened to the space in the hermetic shell. This constitution increases the height from the oil level to the center of the vent communicating passage and thus decreases the amount of lubricating oil flowing out of the vent communicating passage. As a result, the amount of lubricating oil to be pumped up can relatively be increased.

PREFERRED EMBODIMENTS OF THE INVENTION

Exemplary embodiments of the present invention are described hereinafter with reference to the accompanying drawings.

First Exemplary Embodiment

Figure 1:
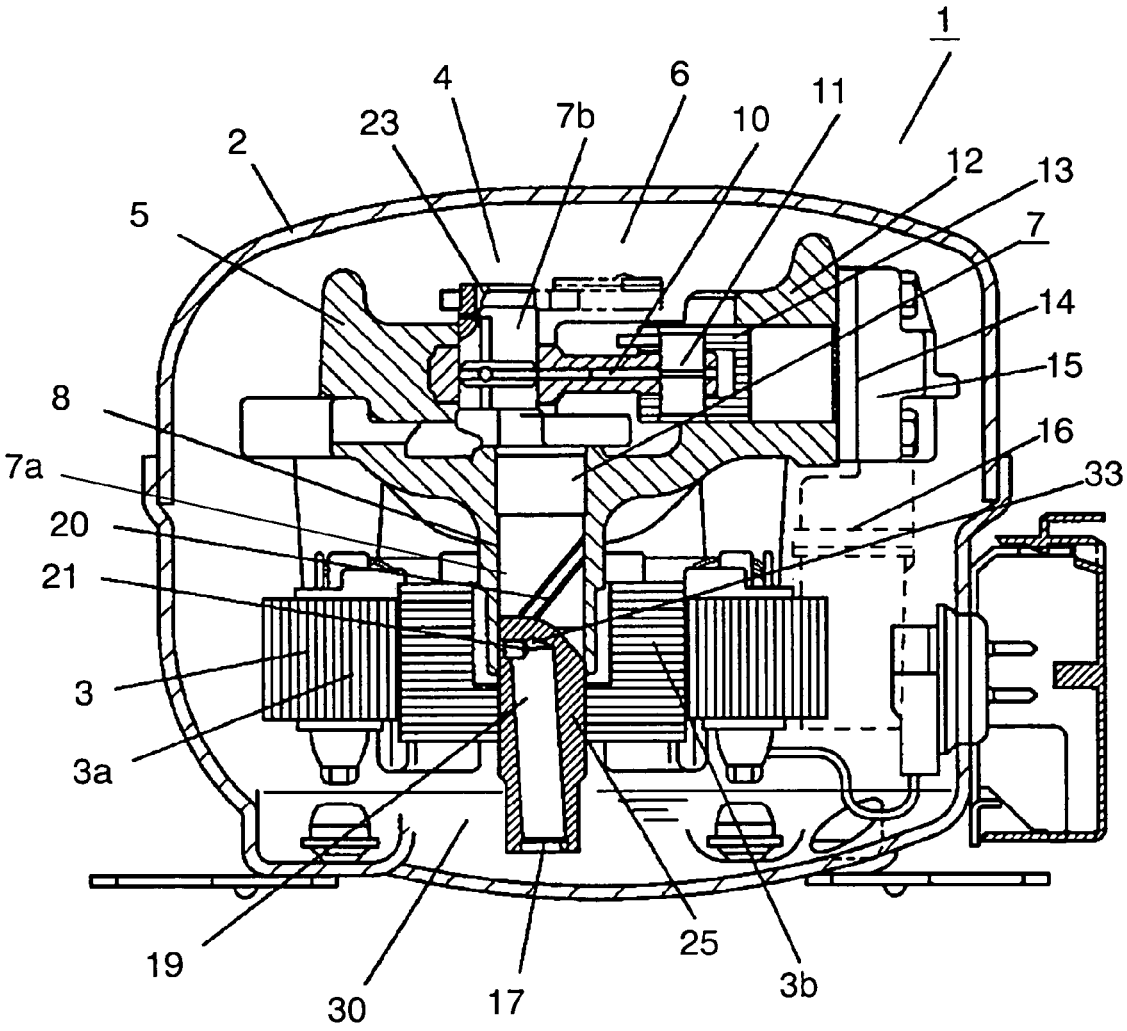
FIG. 1 is a sectional view of a hermetic electric compressor in accordance with a first exemplary embodiment of the present invention.
Figure 2:
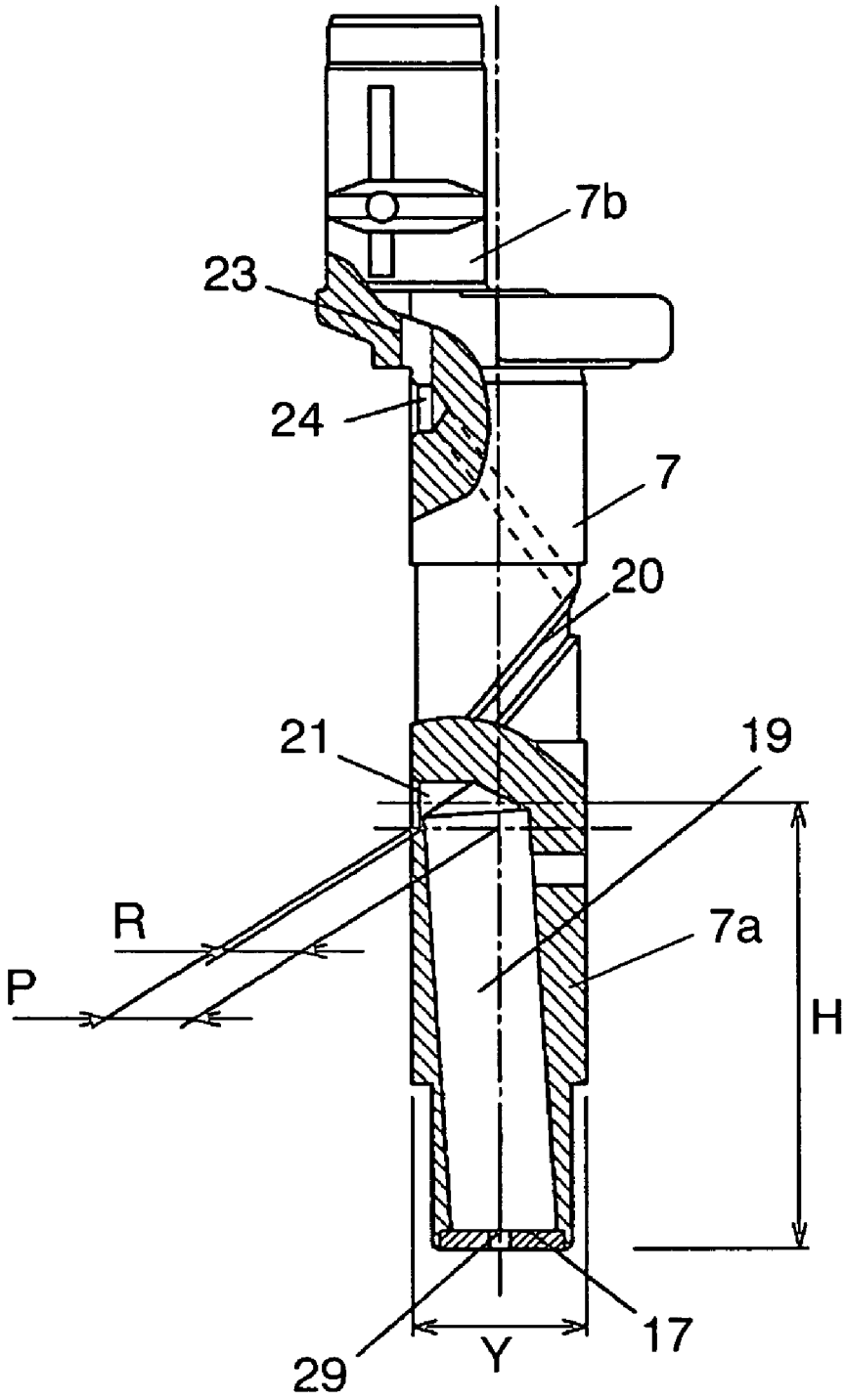
FIG. 2 is a sectional view of an essential part of a crankshaft in accordance with the first exemplary embodiment of the present invention.
Figure 3:
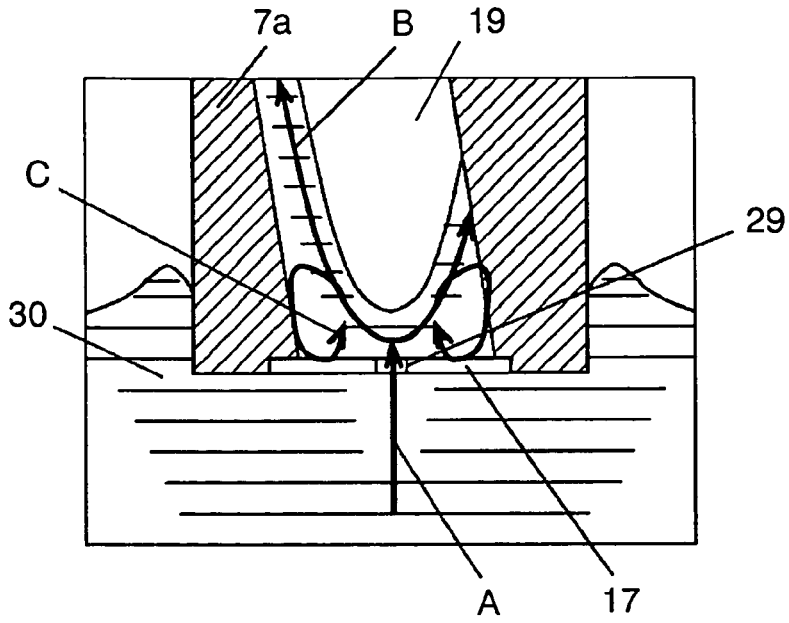
FIG. 3 is a sectional view of an essential part of the crankshaft in accordance with the first exemplary embodiment of the present invention, showing how the lubricating oil is pumped up.

FIG. 1 is a sectional view of a hermetic electric compressor in accordance with the first exemplary embodiment of the present invention. FIG. 2 is a sectional view of an essential part of a crankshaft in accordance with the first exemplary embodiment. FIG. 3 is a sectional view of an essential part of the crankshaft in accordance with the first exemplary embodiment, showing how a lubricating oil is pumped up.

A hermetic electric compressor body 1 is constituted to house an electric motor 3 comprising a stator 3*a* and a rotor 3*b*, and a compressing unit 6 integrated a compressing mechanism 4 by a cylinder block 5 in upper and lower hermetic shell 2. A main crankshaft 7*a* of a crankshaft 7 is supported by a bearing 8 of a cylinder block 5. Coupled to an eccentric crankshaft 7*b* in the upper portion of the crankshaft 7 is a connecting rod 10. Coupled to the connecting rod 10 is a piston 13 for sliding via a piston-pin 11 in a cylinder 12. A valve plate 14 includes a suction port, suction valve, discharge port and discharge valve (each not shown). A cylinder head 15 is partitioned to have a suction chamber and a discharge chamber (each not shown) inside thereof. The cylinder head 15 is coupled to a suction muffler 16. A lubricating oil 30 is reserved in the bottom portion of a hermetic shell 2.

As shown in FIG. 2, a slanting channel 19 is bored in main crankshaft 7*a*. Additionally, at the bottom end of the slanting channel 19, a throttle 17 having a small radius inlet port 29 for sucking the lubricating oil 30 is provided. The slanting channel 19 is a passage for a lubricating oil 30 that is provided to incline with respect to the center axis of main crankshaft 7*a*. The center of inlet port 29 in the throttle 17 is placed at the center of of the slanting channel.

As shown in FIG. 1, the slanting channel 19 is bored so that the top end thereof reaches the lower portion of bearing 8 of the cylinder block 5. At the top end of the slanting channel 19, the slanting channel 19 is provided in the proximity of the outer peripheral surface of main crankshaft 7*a*. As shown in FIGS. 1 and 2, a spiral groove 20 is provided in the outer periphery of main crankshaft 7*a* above the slanting channel 19. The spiral groove 20 is in communication with the slanting channel 19 at a lower communicating passage 21 provided at the top end of the slanting channel 19. Further, at the top end of the spiral groove 20, an upper communicating passage 24 in communication with through-hole 23 in the eccentric crankshaft 7*b* is provided.

As shown in FIG. 2, each numerical value in such a constitution is defined as follows. Y is a diameter of the main crankshaft 7*a* in the area in which the slanting channel 19 is bored. H is a height from the bottom end of the main crankshaft 7*a* to the center of a lower communicating passage 21. The ratio of the height H from the bottommost end of main crankshaft 7*a* to the center of lower communicating passage 21 to the diameter Y of main crankshaft 7*a* is set to E (E=H/Y). Further. P is a radius of the main crankshaft 7*a*, i.e. Y/2. R is a maximum length from the center axis of the main crankshaft 7*a* to an outer diameter of the slanting channel 19. The ratio of the maximum length R from the center axis of main crankshaft 7*a* to the outer diameter of slanting channel 19 to the radius P of main crankshaft 7*a* is set to F (F=R/P).

Next, an operation of the hermetic electric compressor in this constitution is described.

FIG. 3 is a sectional view of an essential part of the bottom end portion of the main crankshaft 7*a*, showing how the lubricating oil 30 in the slanting channel 19 is pumped up when the crankshaft 7 rotates. By a centrifugal force resulting from a rotation of the crankshaft 7, the lubricating oil 30 in the slanting channel 9 is formed to a free surface shaped like a parabola. A lubricating oil flow A through the inlet port 29 provided in the throttle 17 that is shown by the arrow is separated into two branches B and C each shown by each arrow. The branch B is moved upwardly by the centrifugal force. The branch C slips along the inner surface of the slanting channel 19. This branch C reflects from the inner surface of the throttle 17 and merges with the branch B to repeat short circuits. However, a phenomenon of the lubricating oil 30 that has flown into the slanting channel 19 once and flown out of the slanting channel 19, which is described in the prior art, can be avoided. Therefore, the loss in the amount of lubricating oil 30 flowing into the slanting channel 19 can remarkably been inhibited. In other words, because the throttle 17 receives the downward force, the upward force is larger than that of the prior art, thereby increasing the force of delivering the lubricating oil 30 upwardly in the slanting channel 19.

Figure 4:
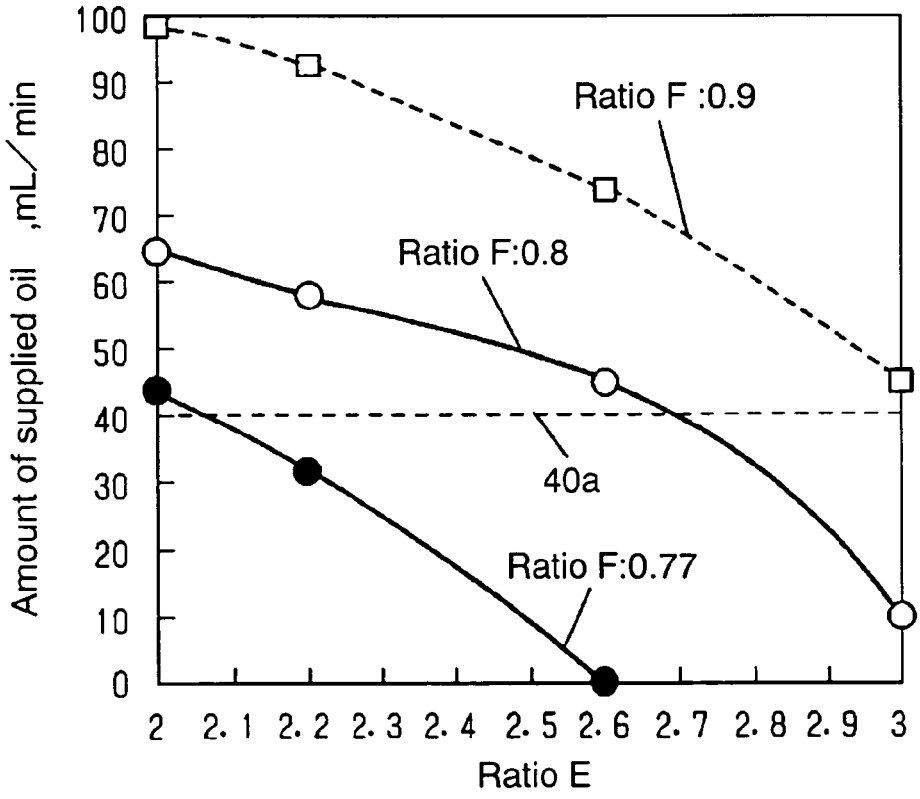
FIG. 4 is a characteristic showing a relation between an amount of supplied oil and a ratio E by setting ratio a ratio F as a parameter.

FIG. 4 shows a relation between an amount of supplied oil and the ratio E (E=H/Y) using the crankshaft 7 having an equal outer diameter. E is the ratio of height H from the bottommost end of main crankshaft 7*a* to the center of lower communicating passage 21 to diameter Y of main crankshaft 7*a*. At this time, the ratio F (F=R/P) is used as a parameter. F is the ratio of maximum length R from the center axis of main crankshaft 7 to the outer diameter of slanting channel 19 to radius P of main crankshaft 7*a*. In the shown results, the rotation of the crankshaft 7 in operation is constant, i.e. 1,200 rpm. The lubricating oil used is ester oil having a viscosity ranging from 10 to 15 $mm^2$/sec. As obviously from FIG. 4, for any ratio F, a tendency of an amount of supplied oil to decrease with an increase of the ratio E is confirmed.

In order to pump up the lubricating oil 30, it is a prerequisite condition that the upward force resulting from the centrifugal force that is exerted on the lubricating oil 30 overcomes the downward force resulting from gravity or a slip. At the smaller ratio E, the upward delivering force is stronger. FIG. 4 also shows a tendency of an amount of supplied oil to increase with an increase of the ratio F This is because the centrifugal force exerted on the lubricating oil 30 in the slanting channel 19 is larger at the larger ratio F Naturally, the delivering force is stronger when the ratio F approximates to 1.

FIG. 4 also shows a lubrication limit line 40*a*, i.e. 40 ml/min., as an example in this embodiment. When the amount of lubricating oil 30 supplied to the upper portion of the crankshaft 7 is under the lubrication limit line, a supply of lubricating oil 30 to the sliding part is insufficient and thereby a wear and tear may occur.

Figure 5:
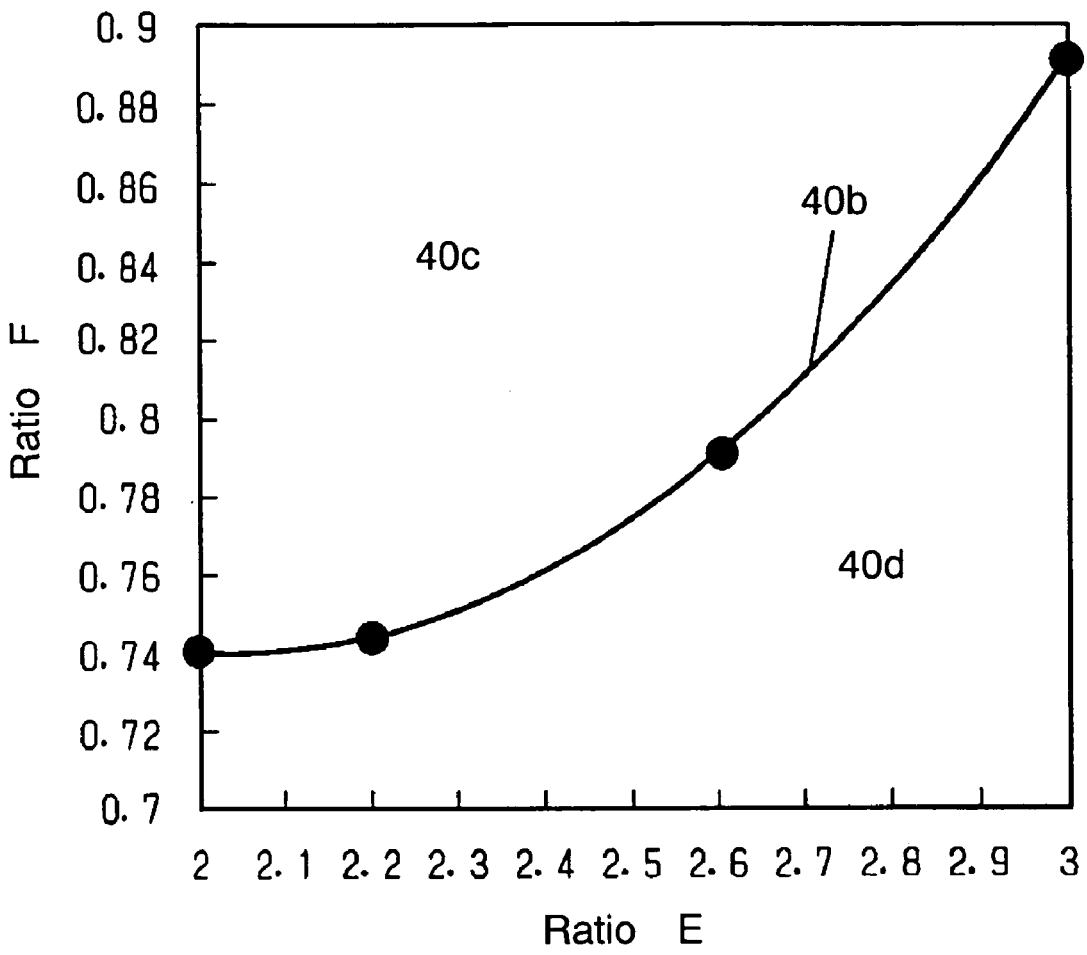
FIG. 5 is a characteristic showing a relation between a ratio E and F derived from FIG. 4.

FIG. 5 shows a relation between the ratio E and the ratio F based on the results of FIG. 4 in which an amount of supplied oil of 40 ml/min. can be ensured in operation at a rotation speed of 1,200 revolutions per minute (rpm). FIG. 5 shows a lubrication limit line 40*b* above which an amount of supplied oil of 40 ml/min. can be ensured in operation at a rotational speed of 1,200 rpm. The lubrication limit line 40*b* is expressed by Equation (2). On the other hand, there is a sufficient lubrication region 40*c* above the lubrication limit line 40*b*, in which an amount of supplied oil not less than 40 ml/min. can be ensured. This region is expressed by the Equation (1). Further, there is an insufficient lubrication region 40*d* below the lubrication limit line 40*b*, in which an amount of supplied oil is less than 40 ml/min. This region is expressed by the Equation (3).

$$F \geqq 0.166E^2 - 0.683E + 1.44 \quad (1)$$

$$F = 0.166E^2 - 0.683E + 1.44 \quad (2)$$

$$F < 0.166E^2 - 0.683E + 1.44 \quad (3)$$

These results show that the compressor should be designed so that the ratio E and F satisfy the Equation (1), in order to ensure an amount of supplied oil of 40 ml/min.

Figure 6:
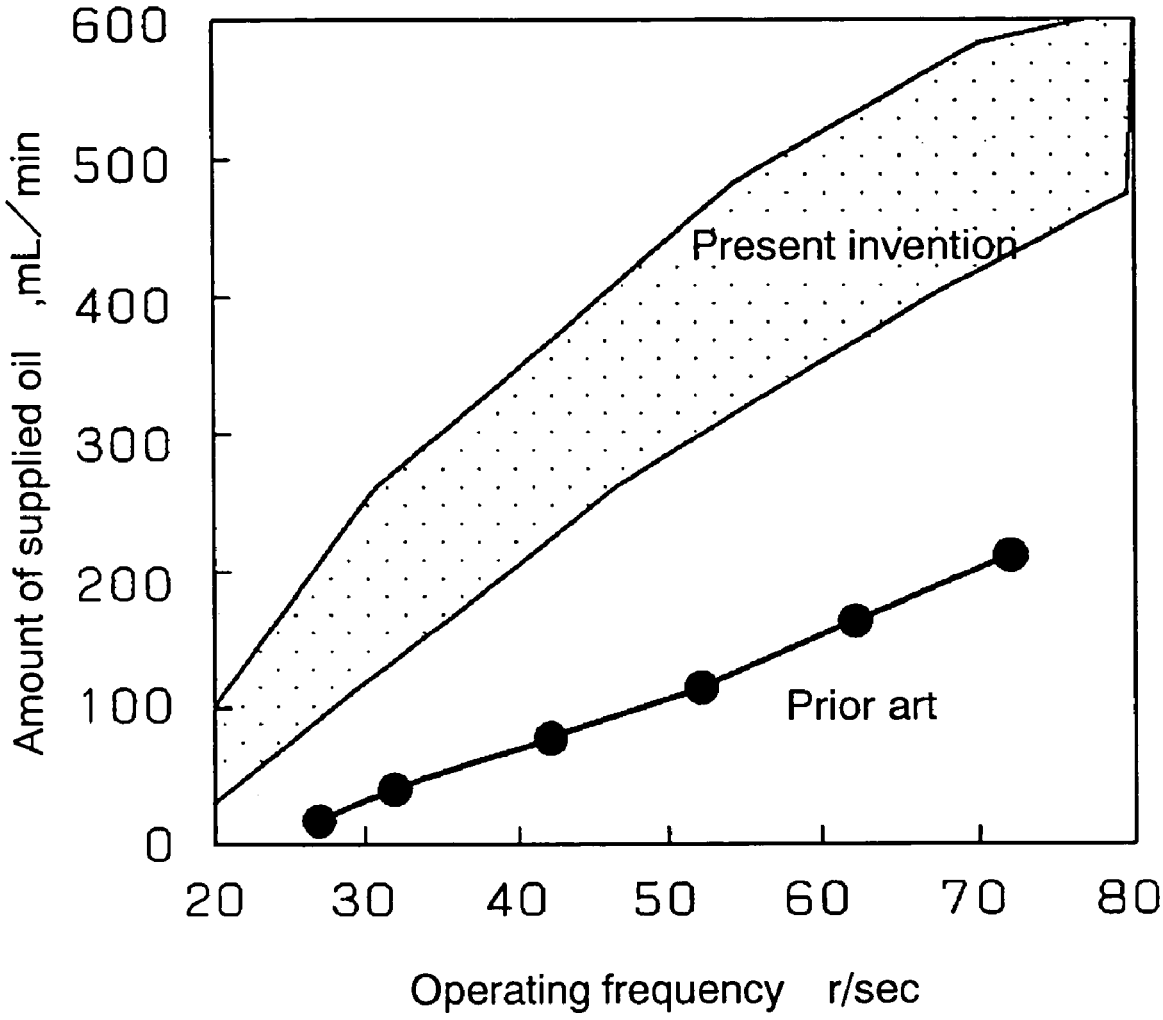
FIG. 6 is a characteristic showing a relation between an operating frequency and an amount of supplied oil.

FIG. 6 is showing a correlation between the revolutions in operation and the amount of supplied oil both in the prior art and the present invention, using the main crankshafts 7*a* having an equal diameter. Now, as a dimension of the main crankshaft 7*a* in the present invention, the ratio E ranges 2 to 3, the ratio F ranges from 0.77 to 0.9, and the ratio E and F satisfies the Equation (1). In FIG. 6, the revolutions in operation is shown in an operating frequency. Multiplying an operating frequency in the Fig. by 60 gives the number of revolutions in operation. As obviously from the Fig., the amount of supplied oil of the hermetic electric compressor of the present invention is larger than that of the prior art, in operation at any revolutions. In the present invention, an amount of supplied oil sufficient to lubricate the sliding part can be ensured even in the range of low-speed operation (1,200 to 1,800 rpm). Additionally, together with stable lubrication, the operation at low rotational speeds can minimize the input of the compressor, thereby realizing low power consumptions.

In this exemplary embodiment, the ratio E ranges from 2 to 3. When the ratio E is smaller than 2, there is almost no allowance for the length (approx. 10 to 20 mm) to which the rotor 3*b* is fitted in the lower portion of the main crankshaft 7*b*. Thus, this is not a realistic design. On the other hand, when the ratio E is larger than 3, the pump head is too high to ensure a sufficient amount of supplied oil in the range of low-speed operation (1,200 to 1,800 rpm).

In this exemplary embodiment, the ratio F ranges from 0.77 to 0.9. When the ratio F is smaller than 0.77, the centrifugal force to provide an oil delivering force cannot be obtained and a sufficient amount of supplied oil cannot be ensured in the range of low-speed operation (1,200 to 1,800 rpm). On the other hand, when the ratio F is larger than 0.9, a thickness between the outer peripheral of the main crankshaft 7*a* and the slanting channel 19 is smaller than 1 mm. Therefore, when a compressive load is imposed, chips or cracks may develop in the portion having a small thickness.

Consequently, in order to design a lubricating system of the crankshaft 7 capable of performing compressing operation even in the low-speed operation, it is desirable to set the ratio E to the range of 2 to 3, the ratio F to the range of 0.77 to 0.9, and use the Equation (1) as the relation between the ratio E and the ratio F.

Generally, a temperature of the compressing mechanism 4 comprising the piston 13 and the cylinder 12 is higher than that of the lubricating oil 30 scattered from the top end of the eccentric crankshaft 7*b* of crankshaft 7. Therefore, in the first exemplary embodiment of the present invention, an amount of the lubricating oil 30 sprayed onto the compressing mechanism 4 increases and thereby the cooling effect is fully exerted on the compressing mechanism 4. This inhibits a wear and tear of the surface of the sliding part and improves a reliability. Additionally, because a temperature rise of the gas sucked into the compressing mechanism 4 is inhibited, the efficiency of the hermetic electric compressor can be improved.

Second Exemplary Embodiment

Figure 7:
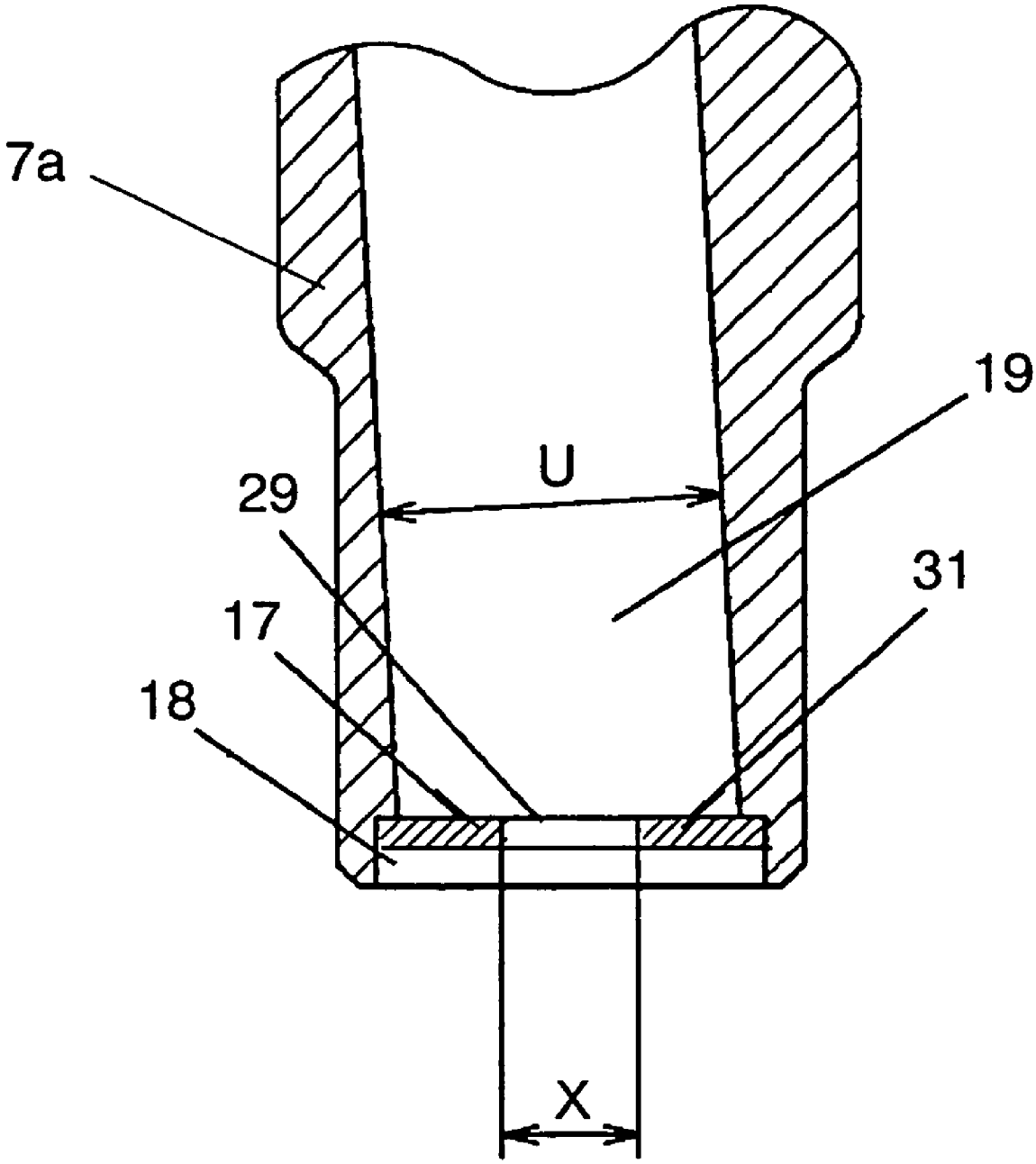
FIG. 7 is an enlarged sectional view of a lower portion of a main crankshaft in accordance with a second exemplary embodiment of the present invention.

FIG. 7 is an enlarged sectional view of a lower portion of a main crankshaft in accordance with the second exemplary embodiment of the present invention.

As shown in FIG. 7, at the bottom end of the main crankshaft 7*a*, an extended tubular part 18 and a throttle 17 are formed. The slanting channel 19 serving as a passage for a lubricating oil is bored from a top end of the extended tubular part 18 so as to incline with respect to the center axis of the main crankshaft 7*b*. The internal diameter of the extended tubular part 18 is formed larger than the diameter of the slanting channel 19. A cap 31 shaped like a flat disk is inserted along and engaged with the inner peripheral of the extended tubular part 18. The cap 31 is formed by punching an ordinary steel stock or the like, and has an inlet port 29 for sucking the lubricating oil 30 at the center thereof. The throttle 17 is a generic term including the extended tubular part 18 and the cap 31 having the inlet port 29.

U is a diameter of the slanting channel 19. X is a diameter of the inlet port 29 provided at the center of the throttle 17. The ratio of the diameter X to the diameter U of slanting channel 19 is set to G (G=X/U).

In the second exemplary embodiment of the present invention, a material of the cap 31 is an ordinary steel stock represented by SS or SK material. The cap 31 is shaped like a disk by punching the steel stock, and press-fitted along the inner periphery of the extended tubular part 18. Thus, the cap 31 can be realized at low cost and with high workability. Additionally, a step formed by a difference in a diameter between the extended tubular part 18 and the slanting channel 19 allows a stable assembling without positioning misregistration of the cap 31 when the cap 31 is press-fitted.

As for the material of cap 31, the same effect can be obtained by the use of inexpensive non-ferrous metal, plastic material, or the like, instead of the ordinary steel stock.

Figure 8:
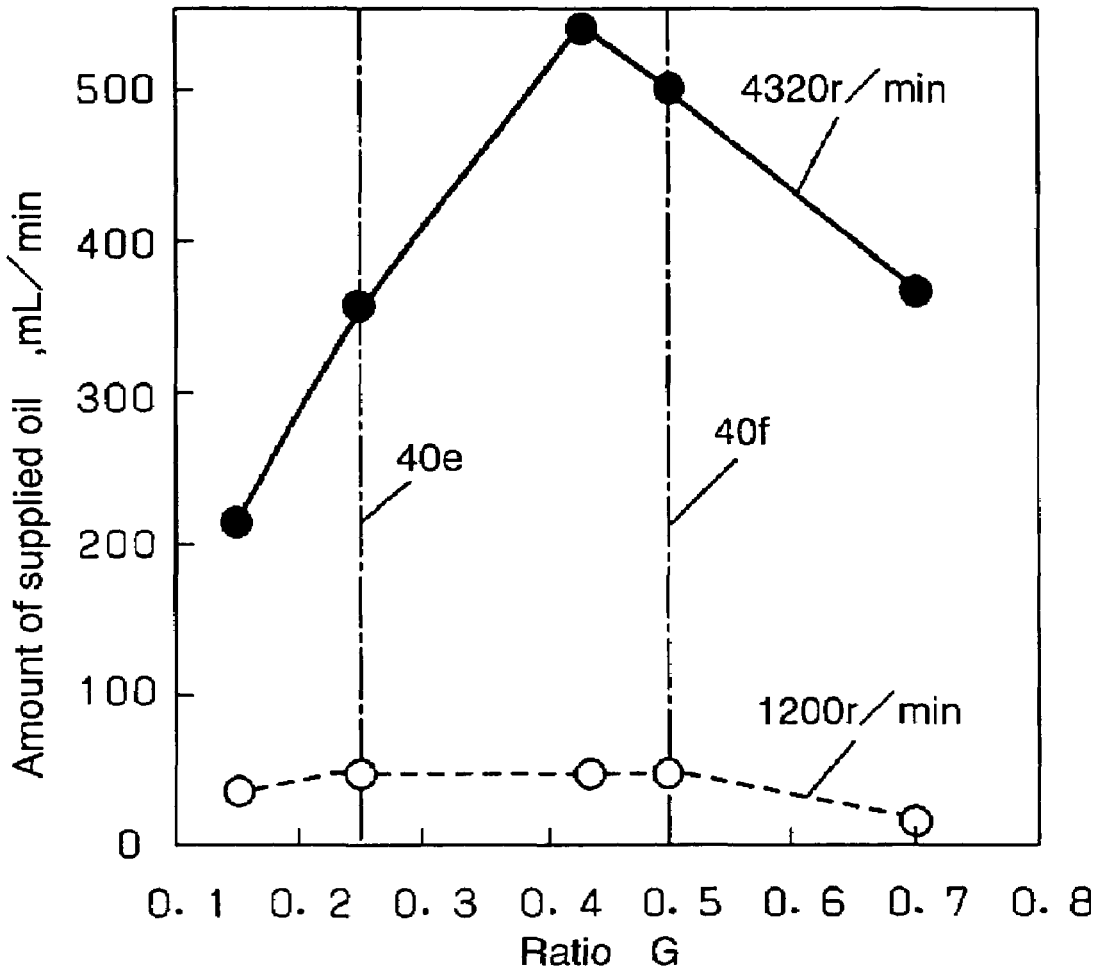
FIG. 8 is a characteristic showing a relation between an amount of supplied oil and a ratio G in accordance with the second exemplary embodiment of the present invention.

Next, FIG. 8 shows the data obtained by measuring the correlation between an amount of supplied oil and the ratio G, using the crankshafts having an equal diameter. In the results of FIG. 8, the representative values under two operation conditions at rotational speeds of 1,200 rpm and 4,320 rpm, are shown with the ratio E set to 2.6 and the ratio F set to 0.82. The lubricating oil used is ester oil having a kinetic viscosity ranging from 10 to 15 $mm^2$/sec. A line 40*e* shows a line along which the ratio G is 0.25. A line 40*f* shows a line along which the ratio G is 0.5. This FIG. 8 shows that a maximum amount of supplied oil point exists within the region of the line 40*e* along which the ratio G is 0.25 to the line 40*f* along which the ratio G is 0.5 at both of 1,200 rpm and 4,320 rpm. Additionally, in operation at 1,200 rpm, there is almost no difference in an amount of supplied oil when the ratio G ranges from 0.25 to 0.5. On the contrary, in operation at 4,320 rpm, a maximum peak is obviously confirmed when the ratio G is approx. 0.43.

As a diameter of the inlet port 29 formed at the center of the throttle 17 is larger, the amount of supplied oil decreases both in high-speed operation and low-speed operation. The reason is why the capability of receiving the downward force generated by the centrifugal force decreases and the loss in the amount of the lubricating oil 30 flowing into slanting channel 19 increases.

On the other hand, in the operation at 4,320 rpm, the amount of supplied oil remarkably decreases as the ratio G is smaller than 0.43. The reason is why the stronger centrifugal force in high-speed operation increases the force of delivering the lubricating oil 30 upwardly, and thus the amount of the lubricating oil 30 sucked through the inlet port 29 cannot follow the amount of lubricating oil 30 to be lifted. Such a tendency of the amount of supplied oil to remarkably decrease with a decrease in the ratio G is confirmed in an operation at rotational speeds more than 3,000 rpm. On the contrary, the amount of lubricating oil 30 sucked through the inlet port 29 is relatively small in the range of low-speed operation. Therefore, there is a wider range in which the amount of lubricating oil 30 sucked through the inlet port 29 can follow the amount of lubricating oil 30 to be lifted. Thus, it is considered that such a range of the ratio G is wider in low-speed operation. The phenomenon of an existence of the range of the ratio G in which an amount of supplied oil is flat in the range of low-speed operation is confirmed at rotational speeds less than 1,800 rpm.

As described above, in the second exemplary embodiment of the present invention, the ratio of the diameter of the slanting channel 19 to the diameter of the inlet port 29 provided at the center of the throttle 17 is 2.0 to 4.0. This constitution can provide an oil pump capable of changing an amount of supplied oil in the range of high-speed operation while maintaining the amount of supplied oil in the range of low-speed operation maximum. Especially when a remarkably large amount of the lubricating oil 30 is discharged from the top end face of the eccentric crankshaft 7*b* in the upper portion of the crankshaft 7 in the range of high-speed operation, a noise may be caused by splashing the lubricating oil 30, depending on a thickness, a material, or a shape of the hermetic shell 2 or a shape of cylinder block 5. However, in the second exemplary embodiment, the selection of an adequate ratio G from the range of 0.25 to 0.5 can set an amount of supplied oil appropriate for each number of revolutions in operation and prevent the noise problem caused by splashing the lubricating oil 30 especially in the range of high-speed operation.

Third Exemplary Embodiment

Figure 9:
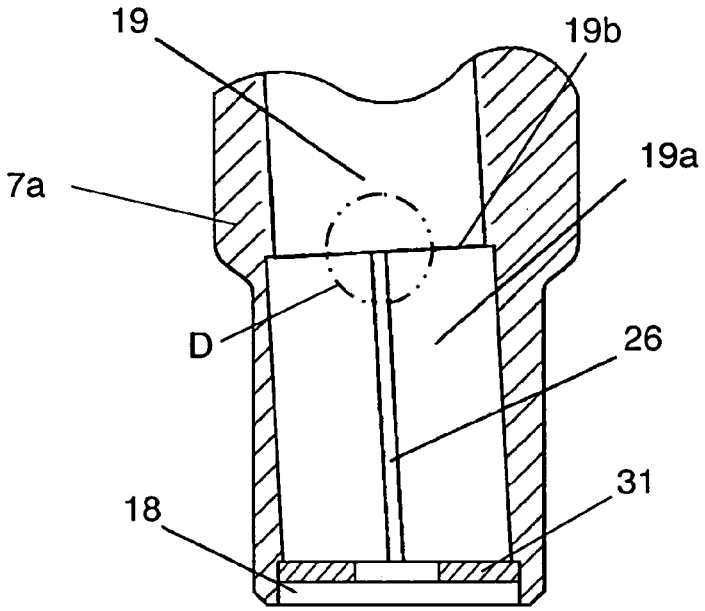
FIG. 9 is an enlarged sectional view of a lower portion of a main crankshaft in accordance with a third exemplary embodiment of the present invention.
Figure 10:
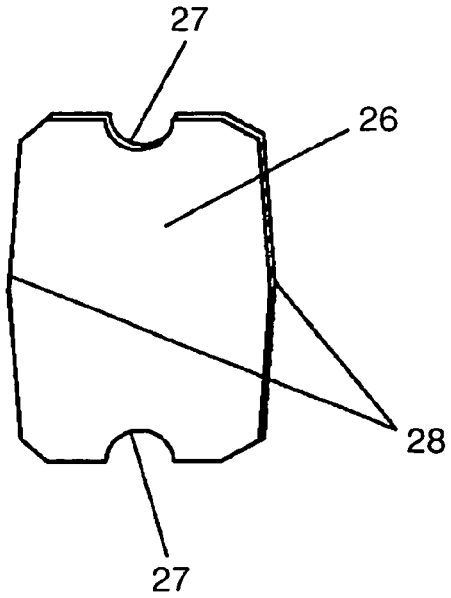
FIG. 10 is a perspective view of a divider.
Figure 11:
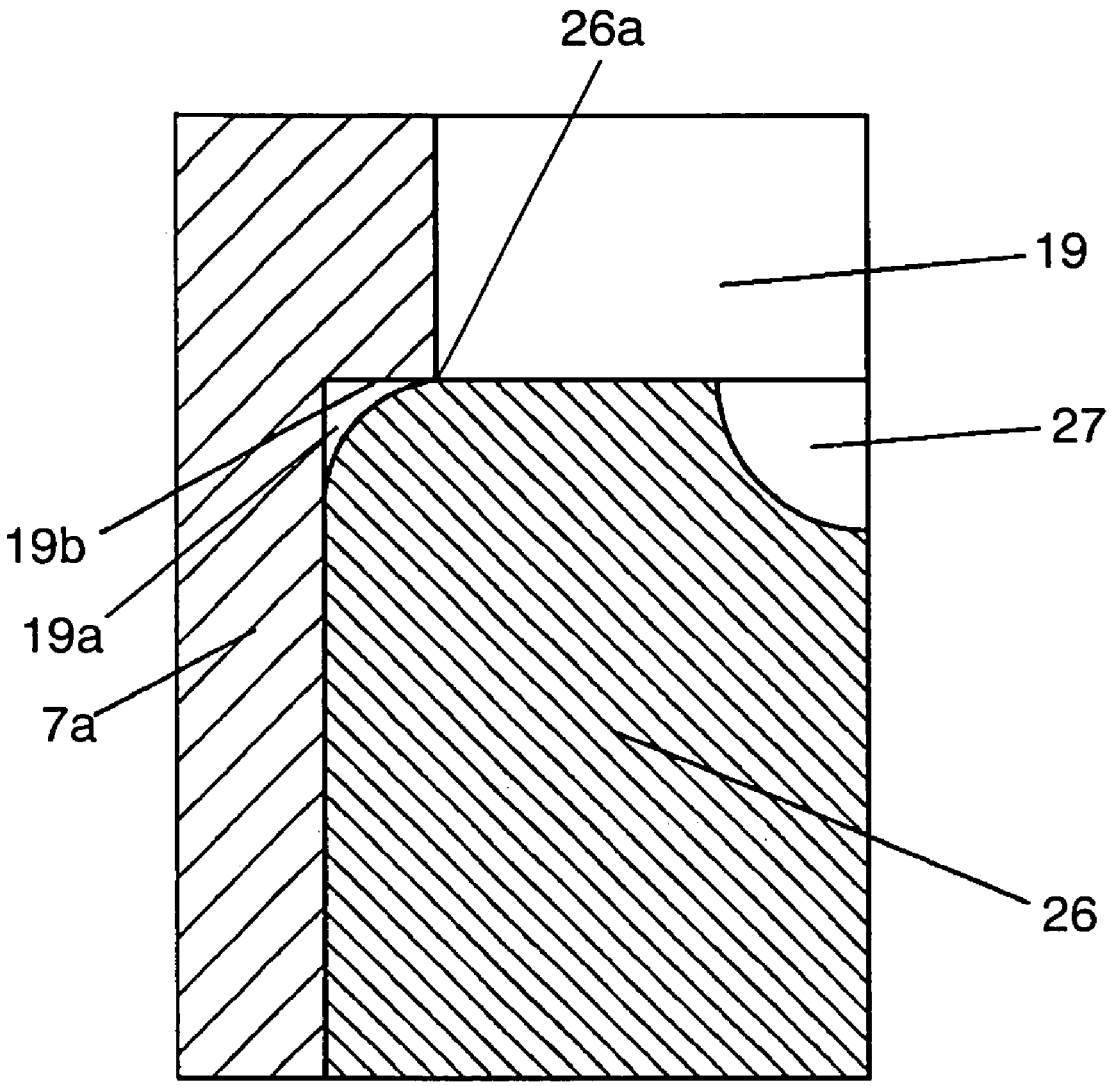
FIG. 11 is an enlarged sectional view of portion D of FIG. 9.

FIG. 9 is an enlarged sectional view of a lower portion of a main crankshaft in accordance with the third exemplary embodiment of the present invention. FIG. 10 is a perspective view of a divider. FIG. 11 is an enlarged sectional view of the D portion of FIG. 9.

An extended tubular part 18 is formed at the bottom of a main crankshaft 7*a*. The slanting channel 19 is a passage for lubricating an oil provided from the top end of the extended tubular part 18. The inner diameter of the slanting channel 19 includes the center of the extended tubular part 18. A divider 26 is shaped like a thin flat plate that is press-fitted into the slanting channel 19. The divider 26 has a semi-circular notch 27 at each of the top and bottom ends thereof. The divider 26 is formed symmetrically at the upper and lower sides so that it can be inserted from any of top and bottom ends. The divider 26 has a press fit portion 28 in which substantially an intermediate portion of the divider is formed slightly wider. The diameter of the slanting channel 19 is decreased stepwise at least once from the top end of the extended tubular part 18 so that the slanting channel has at least one step. There is a step 19*b*, a boundary between a first-step slanting channel 19*a* having the largest diameter in the slanting channel 19 and a second-step slanting channel. The first-step slanting channel 19*a* is formed to be as high as divider 26.

The lubricating oil 30 that has flown into the slanting channel 19 moves upwardly while it rotates according to the rotation of the crankshaft 7. However, because the viscosity of the lubricating oil 30 serves as a resistance force against the rotation direction in the slanting channel 19, the rotational speed of the lubricating oil 30 in the slanting channel 19 tends to be smaller than the actual rotational speed of the crankshaft 7. Especially in the range of low-speed operation (1,200 to 1,800 rpm), the temperature rise of the lubricating oil 30 caused by the heat generated by the motor or a sliding is small and thus the viscosity of the lubricating oil 30 is kept relatively high. This makes a large difference in a rotational speed between the lubricating oil 30 and the crankshaft 7. Such a difference in rotational speed between the crankshaft 7 and the lubricating oil 30 in the slanting channel 19 largely affects and deteriorates an oil delivering force.

For the third exemplary embodiment of the present invention, the oil delivering force is improved by agitating up the lubricating oil 30 by stirring the divider 26 inserted into and engaged with the slanting channel 19. Thus, the rotational speed of the lubricating oil 30 that has flown into the slanting channel 19 is substantially the same as the actual rotational speed of the crankshaft 7 and sufficient oils is lifted even in the range of low-speed operation.

Because substantially semi-circular notches 27 are provided at both ends of the divider 26, the ratio of two divided openings of the inlet port in the throttle 17 is kept unchanged even if the divider 26 is displaced from the center of the throttle 17. The divider 26 also has the press fit portion 28 in which the width in the vicinity of the longitudinal center of the divider 26 is increased. The press fit portion 28 allows an easy insertion and fixation of the divider 26. The divider 26 can be assembled without an extremely small bend. Thus, the workablity in assembling is improved.

Additionally, the diameter of the slanting channel 19 is decreased stepwise at least once from the top end of the extended tubular part 18 so that the slanting channel 19 has at least one step. The depth of the first-step slanting channel 19*a* from the top end of the extended tubular part 18 is equal to the height of the divider 26. When the cap 31 is fitted into the extended tubular part 18, the cap 31 is brought into contact with the bottom end face of the divider 26 and a load may be imposed on the divider. Even in such a case, the edge 26*a* at the top end face of the divider 26 is restricted by the step 19*b* of the slanting channel 19. This allows assembling without positioning divider 26 by mistake.

Fourth Exemplary Embodiment

Figure 12:
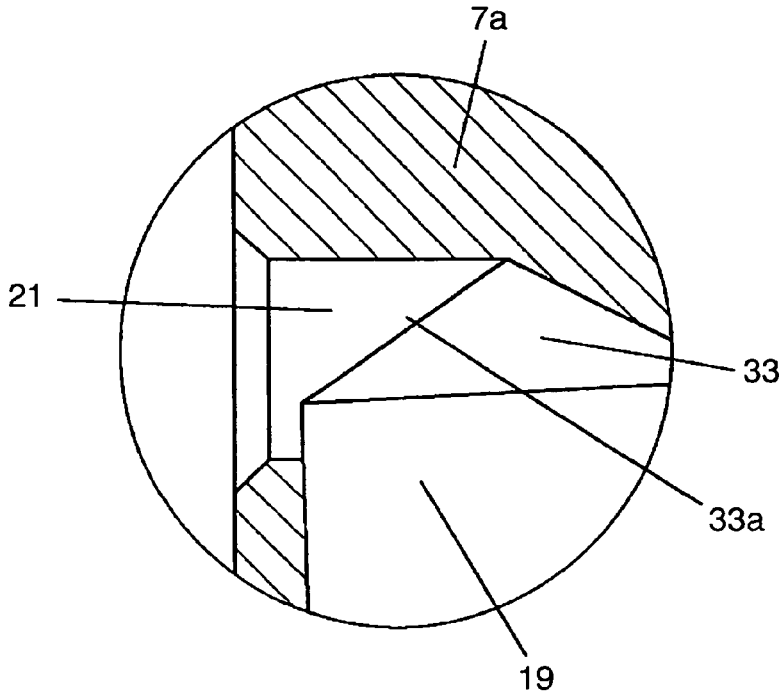
FIG. 12 is an enlarged sectional view of a top end portion of a slanting channel in a main crankshaft in accordance with a fourth exemplary embodiment of the present invention.

FIG. 12 is an enlarged sectional view of a top end portion of a slanting channel in a main crankshaft in accordance with the fourth exemplary embodiment of the present invention.

The main crankshaft 7 has the slanting channel 19, and a conical portion 33 at the top end of the slanting channel 19. The conical portion 33 has a ridge portion 33*a*. Further provided is a lower communicating passage 21 for further lifting the lubricating oil 30 in the slanting channel 19.

Now, the slanting channel 19 inclines from the lower portion to the upper portion of the main crankshaft 7 toward the outer peripheral side of the main crankshaft 7, in order to effectively lift up the head of the lubricating oil and ensure the amount of supplied oil in the low-speed operation range. For this reason, when the lower communicating passage 21 is consisted to penetrate the side inner wall of the slanting channel 19, the upper end portion of the slanting channel is the most thinnest because the upper end portion of the slanting channel 19 and the conical portion 33 are inevitably located above the lower communicating passage 21. Therefore, when a spiral groove (not shown) is formed upwardly from the lower communicating passage 21, a corrosion (a phenomenon of breakage at the lowest portion of the spiral groove developing into a large hole that occurs in a thin portion) may occur between the lowest portion of the spiral groove 20, the upper end of the slanting channel 19, and conical portion 33.

However, in the fourth exemplary embodiment, the lower communicating passage 21 or a part thereof is formed of the ridge portion 33*a* of the conical portion 33 at the top end of the slanting channel 19. Thus, in addition to ensuring an amount of supplied oil in the range of low-speed operation, a sufficient thickness is ensured in the portion above the lower communicating passage 21 of the main crankshaft 7. Therefore, even when the spiral groove 20 is formed, a corrosion in this portion can be prevented and the loss in manufacturing cost can be reduced.

Fifth Exemplary Embodiment

Figure 13:
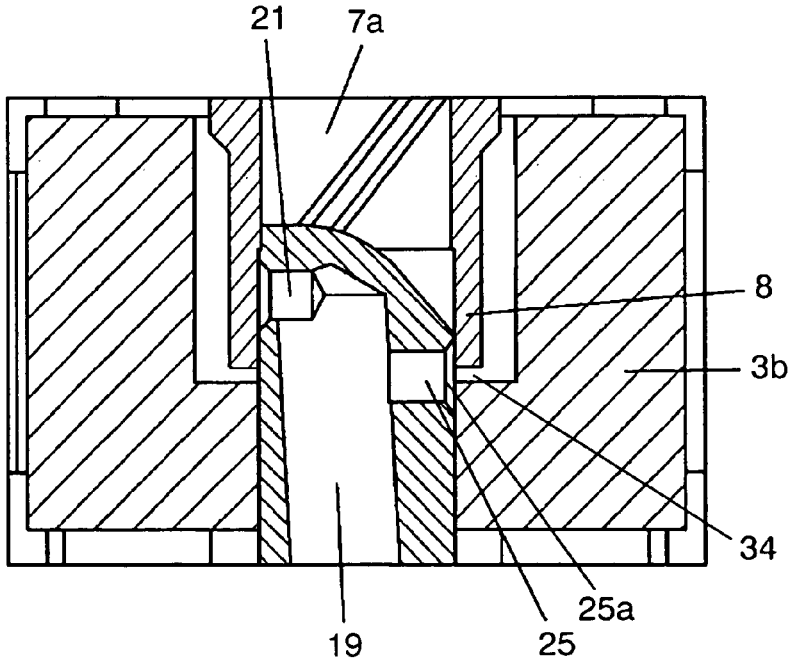
FIG. 13 is an enlarged sectional view of a bearing for a main crankshaft in accordance with a fifth exemplary embodiment of the present invention.
Figure 14:
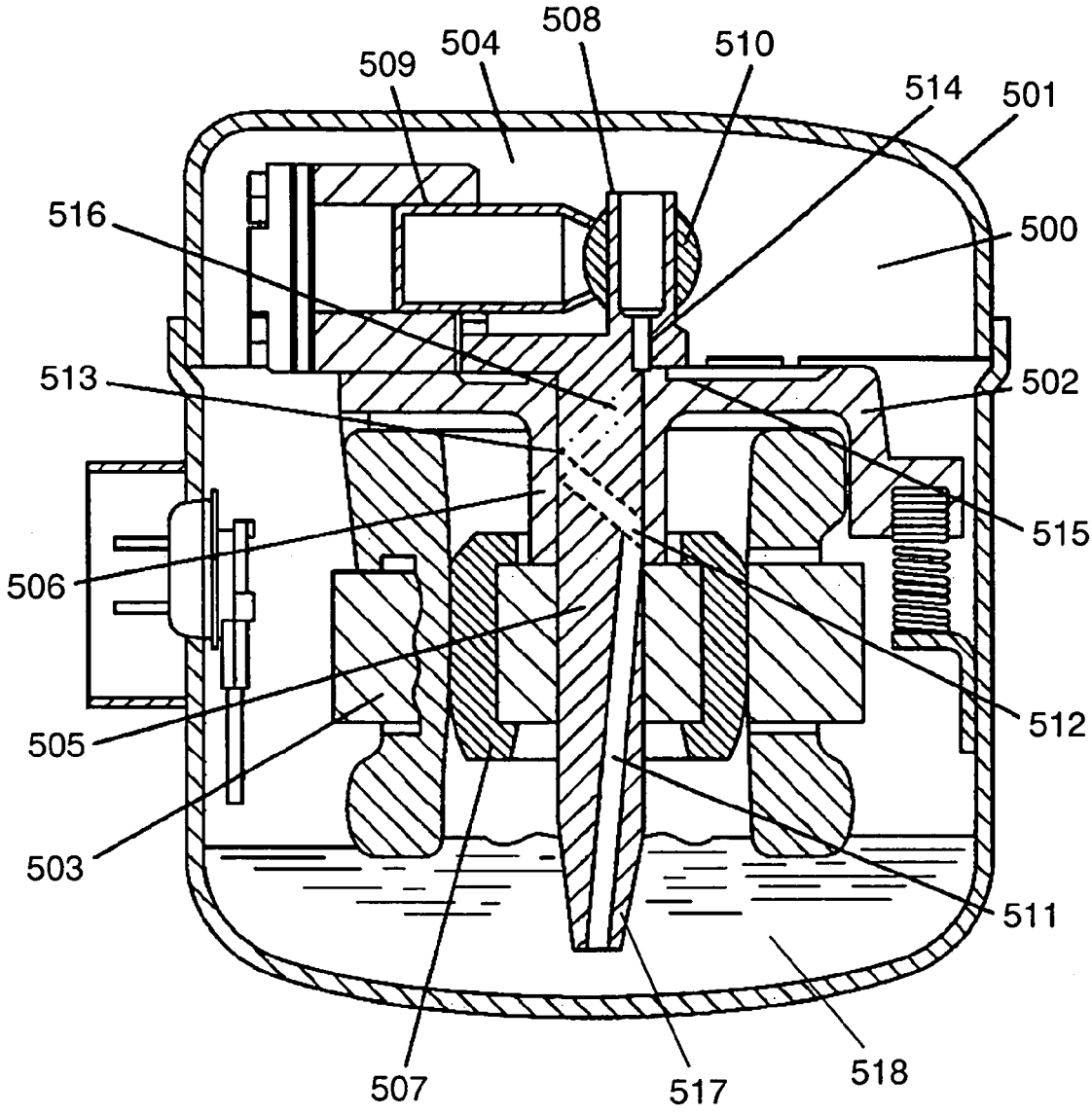
FIG. 14 is a sectional view of a conventional hermetic electric compressor.
Figure 15:
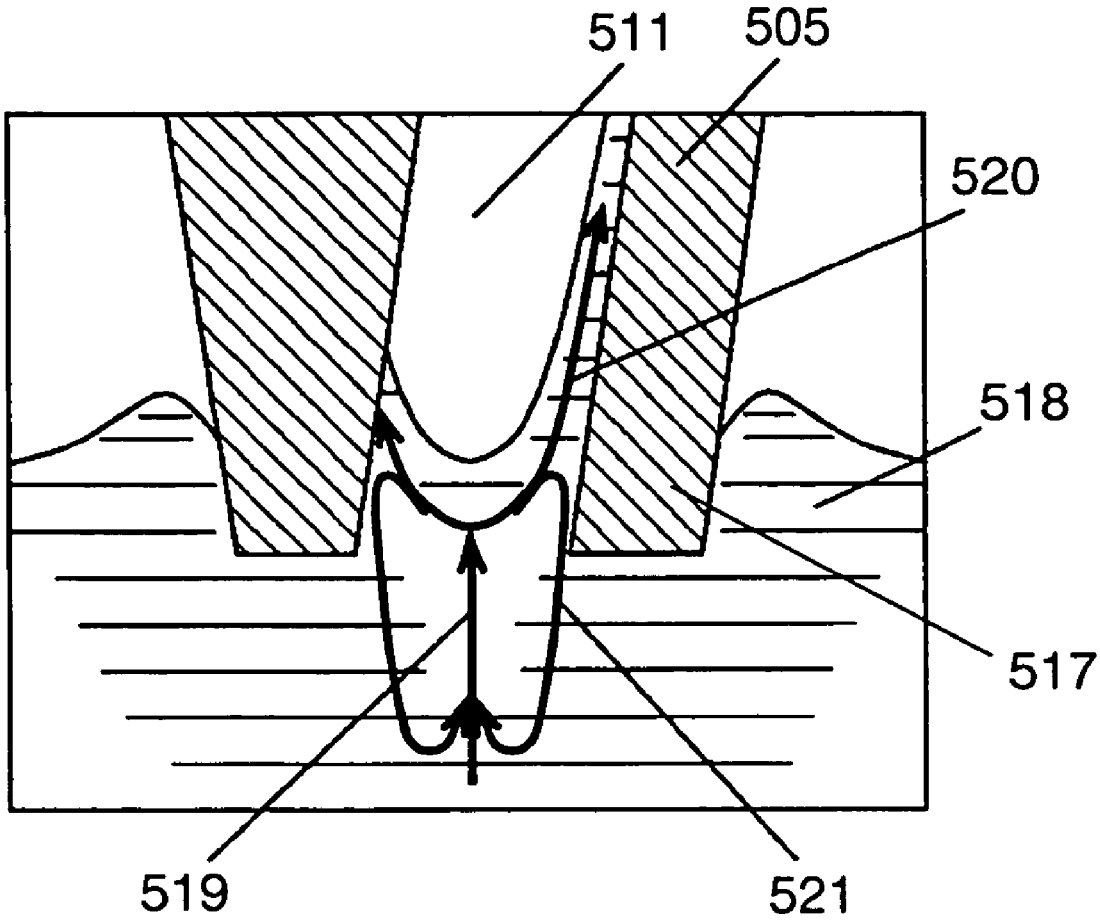
FIG. 15 is a sectional view of an essential part of the conventional how to pump up a lubricating oil shown in FIG. 14.

FIG. 13 is an enlarged sectional view of a bearing for a main crankshaft in accordance with the fifth exemplary embodiment of the present invention.

In the crankshaft 7, the main crankshaft 7*a* is supported by a bearing 8 of a cylinder block. The rotor 3*b* is shrink-fitted to the main crankshaft 7*a*. The main crankshaft 7*a* has the slanting channel 19 inside thereof. A vent communicating passage 25 for providing a communication between the slanting channel 19 and the outer peripheral surface of the crankshaft 7*a* is provided in a position of clearance 34 formed between the bottom end of the bearing 8 of the cylinder block and the top end of the rotor 3*b*.

In the fifth exemplary embodiment of the present invention, in order to prevent an insufficient lubrication phenomenon in which gas retained in the slanting channel 19 causes a choke and hinders the lubricating oil 30 from going up, the gas retained in the slanting channel 19 can effectively be released from the vent communicating passage 25 through the clearance 34. Additionally, because the height from the oil sump to the center of the vent communicating passage 25 is sufficiently ensured, the rate of the amount of lubricating oil flowing out of the vent communicating passage 25 is decreased. This can ensure an amount of supplied oil sufficient to contribute to lubricate the sliding parts.

At least a part of the vent communicating passage 25 in the fifth exemplary embodiment extends to the sliding part comprising the main crankshaft 7*a* and the bearing 8. Beveling an outlet port 25*a* of the vent communicating passage 25 opened to the outer peripheral side of the main crankshaft 7*a* can prevent a shortage of oil film on the journal bearings comprising the bearing 8 of the cylinder block and the outer peripheral surface of the main crankshaft 7*a*.

Further, in order to release a gas from the slanting channel 19 and prevent a shortage of oil film on the journal bearing at the same time, it is desirable to set the diameter of the outlet port 25*a* to 3 to 6 mm and the bevel angle to 90° to 120°.

INDUSTRIAL APPLICABILITY

As described above, the present invention includes an oil pump. The oil pump comprises: a slanting channel formed in the lower portion of a main shaft and inclining from the lower portion to the upper portion thereof outwardly; a throttle formed at the bottom of the main shaft and having an inlet port of diameter smaller than the section of the slanting channel; and a lower communicating passage for providing communication between the bottom end of a spiral groove and the slanting channel. The centrifugal force resulting from a rotation of a crankshaft is exerted on lubricating oil at the bottom end of the main crankshaft surrounded by the throttle. The throttle receives the downward force generated by the centrifugal force. This increases the upward force and allows the lubricating oil to move upwardly in the slanting channel. Further, the incline of the slanting channel effectively lifts the head of the lubricating oil to provide a large oil delivering force. This can realize a hermetic electric compressor capable of efficiently pumping up the lubricating oil required even at low speeds of rotation.

The present invention can also provide a hermetic electric compressor having a simple constitution and thus excellent workablity in assembling.

REFERENCE MARKS IN THE DRAWINGS

1 Hermetic electric compressor body
2 Hermetically-sealed upper and lower shells
3 Electric motor
3*a* Stator
3*b* Rotor
4 Compressing mechanism
5 Cylinder block
6 Compressor unit
7 Crankshaft
7*a* Main crankshaft
7*b* Eccentric crankshaft
8 Bearing
10 Connecting rod
11 Piston pin
12 Cylinder
13 Piston
14 Valve plate
15 Cylinder head
16 Suction muffler
17 Throttle
18 Extended tubular part
19 Slanting channel
19*a* First step slanting channel

19*b* Step
20 Spiral groove
21 Lower communicating passage
23 Through-hole
24 Upper communicating passage
25 Vent communicating passage
25*a* Outlet port
26 Divider
26*a* Edge
27 Notch
28 Press fit portion
29 Inlet port
30 Lubricating oil
31 Cap
33 Conical portion
33*a* Ridge portion
34 Clearance

The invention claimed is:

1. A hermetic electric compressor comprising:

an electric motor comprising a stator and a rotor;

a compressing element for compressing refrigerant by a rotation of a crankshaft fixed to the rotor of said electric motor;

a hermetic shell housing said electric motor and said compressing element and including a reservoir arranged to store lubricating oil, said crankshaft comprising at least a main crankshaft, and a eccentric crankshaft for driving said compressing element;

an oil pump for supplying said lubricating oil in said reservoir to an inside of said hermetically-sealed shell by rotation of the crankshaft via said main crankshaft and said eccentric crankshaft by a rotation of said crankshaft, said oil pump being provided inside of said main crankshaft, and said oil pump comprising:

a slanting channel having a predetermined length and provided from a bottom end of said main crankshaft, said slanting channel slanting with respect to a center axis of said main crankshaft, the bottom end of said main crankshaft arranged to be immersed in said stored lubricating oil;

a throttle provided at said bottom end of said main crankshaft and having a cross-sectional area smaller than a cross-sectional area that of said slanting channel;

a communicating passage provided at a top end of said slanting channel;

a spiral groove in communication with said communicating passage, provided in an outer periphery of said main crankshaft; and a through-hole in communication with said spiral groove, provided in said eccentric crankshaft.

2. The hermetic electric compressor of claim 1, wherein a revolution of said main shaft includes from 1,200 to 1,800 revolutions per minute (rpm).

3. The hermetic electric compressor of claim 1, wherein when a ratio of a distance from a bottom end of said main crankshaft to a center of said communicating passage to a diameter of said main crankshaft including said slanting channel is set to E, said ratio E ranges from 2 to 3, and when a ratio of a maximum length from a center axis of said main crankshaft to an outer diameter of said slanting channel to a half of the diameter of said main shaft is set to F, ratio E ranges from 2 to 3 and said ratio F ranges from 0.77 to 0.9.

4. The hermetic electric compressor of claim 3, wherein a relation between said ratio E and said ratio F is shown by the following equation:

$$F0.166E^2-0.683E+1.44.$$

5. The hermetic electric compressor of any one of claims 1 through 4, wherein said throttle is constituted so that a disk-shaped cap is inserted in and engaged with the bottom end of said main crankshaft.

6. The hermetic electric compressor of any one of claims 1 through 4, wherein a ratio of a diameter of said slanting channel to a diameter of the inlet port provided at the center of said throttle is set to 1:0.25 to 0.5.

7. The hermetic electric compressor of any one of claims 1 through 4, wherein a divider for dividing said slanting channel is inserted in and engaged with said slanting channel above said throttle.

8. The hermetic electric compressor of claim 7, wherein said divider is shaped like a vertically symmetrical flat plate, said divider has substantially a semicircular notch at a nearly center of at least a bottom end thereof and a press fit portion, and in said press fit portion, a width of a longitudinal center of said divider is larger than a width of top and bottom ends.

9. The hermetic electric compressor of claim 7, wherein a step is provided in a position in a direction of a depth of said slanting channel, and a distance from a bottom end of said slanting channel to said step is equal to a length of said divider.

10. The hermetic electric compressor of any one of claims 1 through 4, wherein a conical portion is formed at the top end of said slanting channel, and at least a part of said communicating passage intersects said conical portion.

11. The hermetic electric compressor of any one of claims 1 through 4, further comprising a vent communicating passage, said vent communicating passage providing a communication between said slanting channel and an outer peripheral surface of said main crankshaft and being opened to a space in said hermetic shell.

* * * * *